US012618654B2

(12) United States Patent
Prisbell et al.

(10) Patent No.: US 12,618,654 B2
(45) Date of Patent: May 5, 2026

(54) TRANSPORTABLE PERFORATION TOOL

(71) Applicant: Schlumberger Technology Corporation, Sugar Land, TX (US)

(72) Inventors: Andrew Prisbell, Sugar Land, TX (US); Mohamed Mehdi, Houston, TX (US); Jay Garza, La Marque, TX (US); Atsushi Nakano, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/243,432

(22) Filed: Jun. 19, 2025

(65) Prior Publication Data

US 2025/0314470 A1 Oct. 9, 2025

Related U.S. Application Data

(63) Continuation of application No. 18/724,006, filed as application No. PCT/US2023/012466 on Feb. 7, 2023, now Pat. No. 12,366,437.

(60) Provisional application No. 63/307,400, filed on Feb. 7, 2022.

(51) Int. Cl.

| | |
|---|---|
| ***F42B 39/14*** | (2006.01) |
| ***E21B 43/117*** | (2006.01) |
| ***E21B 43/1185*** | (2006.01) |

(52) U.S. Cl.

CPC ..... *F42B 39/14* (2013.01); *E21B 43/117* (2013.01); *E21B 43/1185* (2013.01)

(58) Field of Classification Search

CPC ..... E21B 43/117; E21B 43/119; F24B 39/14

See application file for complete search history.

(56) References Cited

U.S. PATENT DOCUMENTS

| | | | | |
|---|---|---|---|---|
| 5,060,573 | A * | 10/1991 | Montgomery | E21B 29/02 102/275.6 |
| 8,136,439 | B2 * | 3/2012 | Bell | F42B 3/26 166/55 |
| 8,770,301 | B2 * | 7/2014 | Bell | E21B 29/02 166/55 |
| 10,267,611 | B2 * | 4/2019 | Lownds | F42D 5/00 |
| 11,091,987 | B1 * | 8/2021 | Benker | E21B 43/119 |
| 11,098,562 | B2 * | 8/2021 | Box | E21B 41/00 |
| 12,366,437 | B2 * | 7/2025 | Prisbell | E21B 43/117 |
| 2010/0212480 | A1 * | 8/2010 | Bell | F42B 3/24 89/1.15 |

(Continued)

FOREIGN PATENT DOCUMENTS

WO WO-2023150369 A1 * 8/2023 ..... E21B 43/1185

*Primary Examiner* — Jennifer H Gay

(74) *Attorney, Agent, or Firm* — Jeffrey D. Frantz

(57) ABSTRACT

A transportable well completion tool is described. The transportable well completion tool comprises a housing with a charge module disposed within the housing. The charge module comprises explosive charges. An initiator module comprising a detonator is coupled to the housing, and a bulkhead member is disposed within the housing between the initiator module and the charge module. A containment cover is secured to the housing to cover the detonator. The transportable well completion tool can be transported with the containment cover in place, and the containment cover can be removed to connect the well completion tool to a tool string for downhole deployment.

15 Claims, 3 Drawing Sheets

(56) References Cited

U.S. PATENT DOCUMENTS

| | | | | |
|---|---|---|---|---|
| 2014/0053750 | A1* | 2/2014 | Lownds | F42D 1/05 361/248 |
| 2014/0083718 | A1* | 3/2014 | Bell | E21B 43/1185 166/378 |
| 2015/0068765 | A1* | 3/2015 | Bell | E21B 43/1185 166/378 |
| 2021/0079767 | A1* | 3/2021 | Box | E21B 43/119 |
| 2025/0043667 | A1* | 2/2025 | MacGillivray | E21B 43/117 |
| 2025/0076015 | A1* | 3/2025 | Prisbell | E21B 43/117 |
| 2025/0314470 | A1* | 10/2025 | Prisbell | E21B 43/117 |

* cited by examiner

TRANSPORTABLE PERFORATION TOOL

This application is a continuation of U.S. patent application Ser. No. 18/724,006, filed Jun. 25, 2024, which is the National Stage Entry of International Application No. PCT/US2023/012466, filed Feb. 7, 2023, which claims benefit of U.S. Provisional Patent Application Ser. No. 63/307,400, filed on Feb. 7, 2022, which are all incorporated herein by reference.

BACKGROUND

Technical Field

This patent application describes an apparatus for use in completing hydrocarbon production wells. Specifically, a perforation tool is described that can be transported in a fully assembled state.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statement are to be read in this light, and not as admissions of prior art.

Explosive tools are used in hydrocarbon prospecting to create channels within rock formations to increase flow of fluids from a hydrocarbon-bearing formation into a well for production to the surface. A hole is drilled into the formation, and the tool is lowered into the hole. The tool has explosive charges that create jets of hot, relatively dense gas, which project laterally into the wall of the well, and into the formation, opening pathways for fluid flow from the formation into the well.

Such tools, widely known a perforation tools, must be carried to a well site for deployment. Since the tools use explosive charges, transportation of the tools to the well site is heavily regulated. The tools typically have an ignition module and a charge module that are separately transported to the well site to meet transport regulations. The pieces are then assembled at the well site, and the assembly takes some time to accomplish. Perforation tools that can be transported to the well site in a fully assembled state and directly deployed into a well without further assembly (other than attachment to a tool string) are needed.

SUMMARY

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, embodiments may encompass a variety of forms that may be similar to or different from the embodiments set forth below.

Embodiments described herein provide a well completion tool, comprising a tubular housing; a charge module comprising at least one explosive charge within the housing; an initiation module coupled to the housing and comprising a detonator; a bulkhead module within the housing between the charge module and the initiation module; and a containment cover secured to the housing and covering the detonator.

Other embodiments described herein provide a well completion tool, comprising a tubular housing; a charge module comprising at least one explosive charge within the housing; an initiation module coupled to the housing and comprising a detonator; a bulkhead module within the housing between the charge module and the initiation module; and a containment cover secured to an end of the housing and covering the detonator.

Other embodiments described herein provide a method of using a perforation tool, comprising disposing a charge module and a bulkhead member within a housing of the perforation tool; attaching an initiation module to the housing such that the bulkhead member is between the initiation module and the charge module; installing at least one explosive charge in the charge module; installing a detonator in the initiation module; securing a containment cover to the housing to cover the detonator to form a transportable perforation tool; causing the transportable perforation tool to be transported to a well site; at the well site, removing the containment cover from the perforation tool; attaching the perforation tool to a tool string; and deploying the tool string into a well.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, all features of an actual implementation may not be described in the specification. It should be appreciated that in the development of any actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Figure 1:
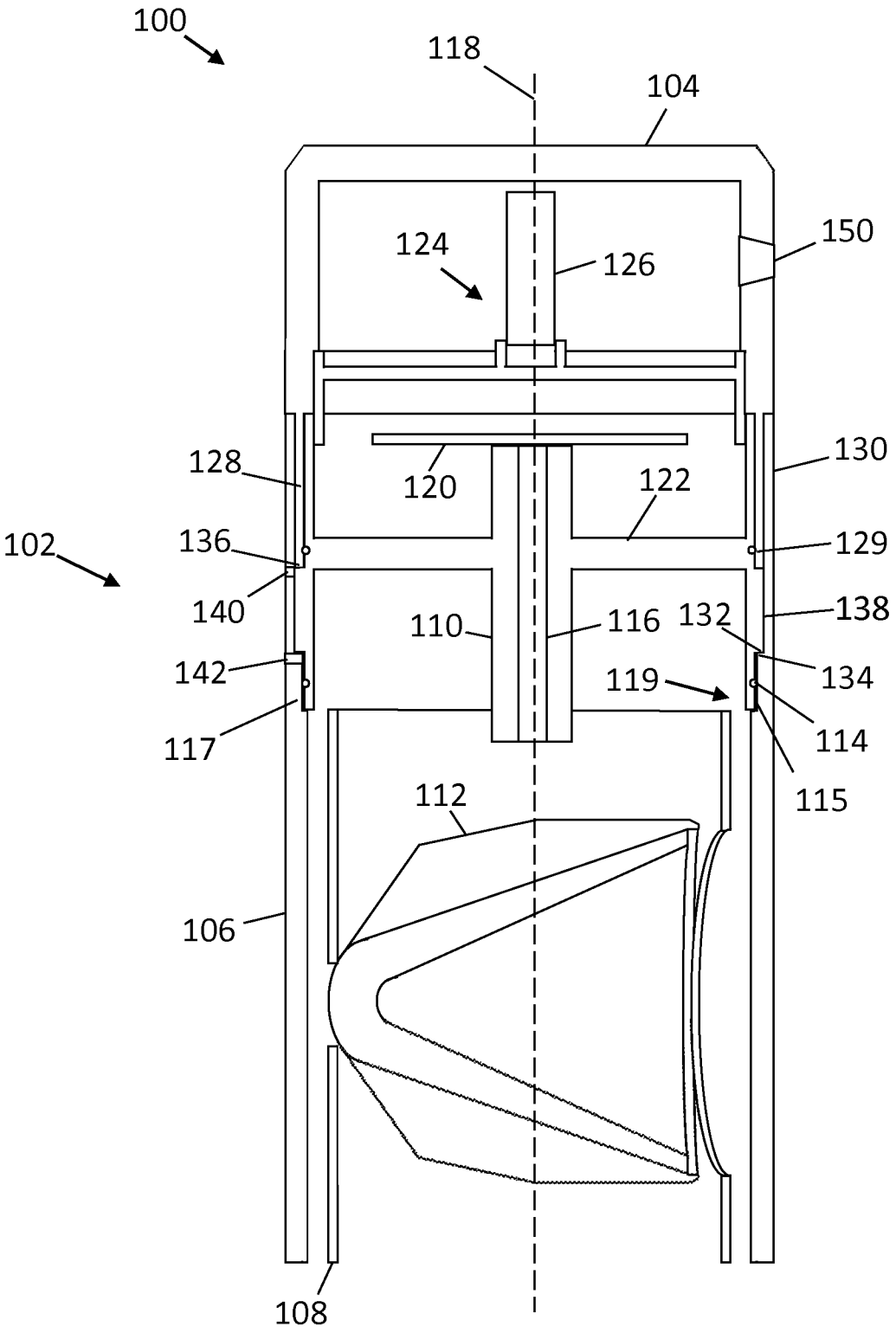
FIG. 1 is a schematic cross-sectional view of a well completion tool, in accordance with embodiments of the present disclosure.

Well completion tools that use explosive charges can be made transportable as fully assembled tools by providing separation between initiation charges and the main charges, and by containing the initiation charge in a way that unwanted discharge thereof does not communicate to the main charges and cause unwanted discharge of the main charges. FIG. 1 is a schematic cross-sectional view of a well completion tool 100, according to one embodiment. The well completion tool 100 has a perforation tool 102 with a containment cover 104 that helps make the tool 102 transportable. The perforation tool 102 has a tubular housing 106 that houses a charge module 108 and a bulkhead member 110 within the housing 106. The charge module 108 has at least one explosive charge 112 installed therein, and may have a plurality of explosive charges 112 deployed therein. The explosive charges 112 may be installed in the charge module 108 in any convenient way. The charges 112 may all point in the same direction, may be phased at different azimuthal displacements, and/or may be rotatable within the housing 106. The housing 106 and the bulkhead member 110 provide containment around the charge module 108 to prevent unwanted transmission of ballistic discharge along the tool 102 to other modules.

The bulkhead member 110 is inserted into an end of the housing 106 adjacent to the charge module 108 and seals with the housing 106 by virtue of a seal member 114 disposed between an outer wall 115 of the bulkhead member 110 and an inner wall 117 of the housing 106 to prevent uncontrolled transmission of combustion products between the initiation module 124 and the charge module 108. The seal member 114 is located adjacent to a first end 119 of the bulkhead member 110 adjacent to the charge module 108. The bulkhead member 110 has an electrical pathway 116 disposed along a central axis 118 of the tool 100 and electrically connected to an activation circuit 120 disposed within the bulkhead member 110. The activation circuit 120 is shown here in a transverse orientation, but could have any orientation. The bulkhead member 110 has a pressure barrier 122 disposed laterally across the bulkhead member 110 from side to side thereof, which provides containment for ballistic discharge on one side of the barrier 122 and a space to house the activation circuit 120 on the other side of the barrier 122.

The perforation tool 102 has an initiation module 124 engaged with the bulkhead member 110, with the bulkhead member 110 located between the initiation module 124 and the charge module 108. The initiation module 124 shown here is configured to connect to an adjacent perforation tool, like the perforation tool 102, to provide a ballistic discharge to activate the charges in the charge module of the adjacent perforation tool. The tool 100 is shown in transportable configuration, with the initiation module 124 safely separated from the charge module 108 by the bulkhead member 110. The initiation module 124 has a detonator 126 positioned along the central axis 118 of the tool 100. The detonator 126 generally extends along the central axis 118 so that when the perforation tool 102 is connected with an adjacent perforation tool the detonator 126 extends toward the charge module of the adjacent perforation tool.

The containment cover 104 is secured to the housing 106 and covers the detonator 126. When secured to the housing 106 and in place covering the detonator 126, the containment cover 104 provides containment for ballistic discharge of the detonator 126 so that the tool 100 can be transported safely. In the configurations shown herein, a perforation tool such as the tool 100 can be safely transported because a potential discharge of the detonator 126 is prevented from causing further discharge of the explosive charge(s) 112.

The containment cover 104 here is in the form of a cylindrical cap with a hollow space to accommodate and contain the detonator 126. The containment cover 104 shown here has a flat end, but as will be described further below, the containment cover 104 can have a curved end. Here, the edge of the flat end is chamfered as an optional feature.

The containment cover 104 is generally constructed to contain a ballistic discharge of the detonator 126. The containment cover 104 is thus made of a material capable of containing such ballistic discharge. The containment cover 104 also has a thickness selected based on the ballistic discharge capacity of the detonator 126. In one example, the containment cover 104 is made of 4330V steel and has a thickness of 1 inch. The thickness may be the same for the top as for the sides, or the thickness may be different for the top and the sides according to the discharge capacity and pattern of the detonator 126. In general, the containment cover may be made of a 150,000 pound steel material.

In this case, the containment cover 104 has a threaded connection 128 that engages with a threaded end 130 of the housing 106 (the threads are not shown in order to simplify the figures). The threaded connection 128 of the containment cover 104 has a number of threads (or thread flights) selected based on the discharge capacity of the detonator 126 in order to assure containment of the discharge without any failure of the secure connection of the containment cover 104 to the housing 106. The threaded connection 128 has a length that extends to engage with a seal member 129 disposed in the outer wall 115 of the bulkhead member 110 at the pressure barrier 122. The threaded connection 128 extends to a location adjacent to the outer wall 115 at the pressure barrier 122 beyond the seal member 129. The outer wall 115 of the bulkhead member 110 can have a shelf 132 that extends radially outward to engage with a corresponding shelf 134 formed in the inner wall 117 of the housing 106. The shelf 132 and the corresponding shelf 134 provide an insertion limit for the bulkhead member 110 within the housing 106.

The outer wall 115 of the bulkhead member 110 can have a second shelf 136 that extends radially outward at a location adjacent to the pressure barrier 122 to provide an engagement limit for the threaded connection 128 of the containment cover 104. The outer wall 115 of the bulkhead member 110, in this case, forms a contact ring 138 between the shelves 132 and 136 that contacts the inner wall 117 of the housing 106.

The housing 106 has two ports, a first port 140 and a second port 142, formed through the housing from the inner wall 117 thereof to an outer wall 115 of the housing 106 at adjacent locations where the contact ring 138 of the outer wall 115 contacts the inner wall 117 of the housing. The ports 140 and 142 are shown here at the same azimuthal location on the circumference of the housing 106, but the ports 140 and 142 could have any relative azimuthal displacement. The ports 140 and 142 provide a method for safely discharging pressure that would result from unwanted discharge of the detonator 126, and removal of any remnant products of the discharge of the charge(s) 112. The first port 140 is located near the second shelf 136 of the bulkhead member 110 when the bulkhead member 110 is fully engaged with the housing 106. In the event the detonator 126 discharges with the containment cover 104 in place, the seal member 129 at the pressure barrier 122 of the bulkhead member 110 prevents communication of combustion products from the side of the pressure barrier 122 facing the initiation module 124 around the outer wall 115 of the bulkhead member 110 to the charge module 108. The pressure contained by the containment cover 104 can be released by partially removing the containment cover 104 such that the threaded connection 128 is no longer in contact with the seal member 129. At that time, gas can flow between the outer wall 115 of the bulkhead member 110 and the threaded connection 128 of the containment cover 104 and can reach the first port 140 to be discharged from the tool 100.

The second port 142 provides a similar function relative to the charges 112. The housing 106 is generally designed to be penetrated by the discharge of a charge 112. The seal member 114 prevents communication of the ballistic discharge from the charge module 108 to the initiation module 124. In the event the bulkhead member 110 needs to be disengaged from the housing 106 prior to discharge of the charges 112, partially removing the bulkhead member 110, sliding the bulkhead member 110 out from the housing 106 far enough to bring the seal member 114 beyond the second port 142, places the second port 142 into fluid communication with the charge module 108. This enables complete removal of the bulkhead member 110 without the opposing force of vacuum developing within the charge module 108.

The containment cover 104 can have a detection feature 150 to indicate the instance of an unwanted discharge of the detonator 126. In this case, the detection feature 150 is a window made of a material that can provide an indication, for example through color change in light reflected from the window due to deposits on the inside surface of the window, that a discharge has occurred. The window, in this case, is a plug that can be a strong, light-transmissive material such as plexiglass, with thickness sufficient to withstand discharge of the detonator 126. The plug can be shaped to provide maximum strength, for example by providing a tapered circumference such that the plug has a wide end at an inner surface of the containment cover 104 and a narrow end at an outer surface of the containment cover 104. In this way, any discharge of the detonator 126 produces a force that tends to compress the detection feature 150 into the wall of the containment cover 104. Under depressured conditions, the plug can be held in place using an adhesive. Other detection features 150 can be used, such as a thin spot of the containment cover 104 to deform in a detectable way upon discharge of the detonator 126.

Figure 2:
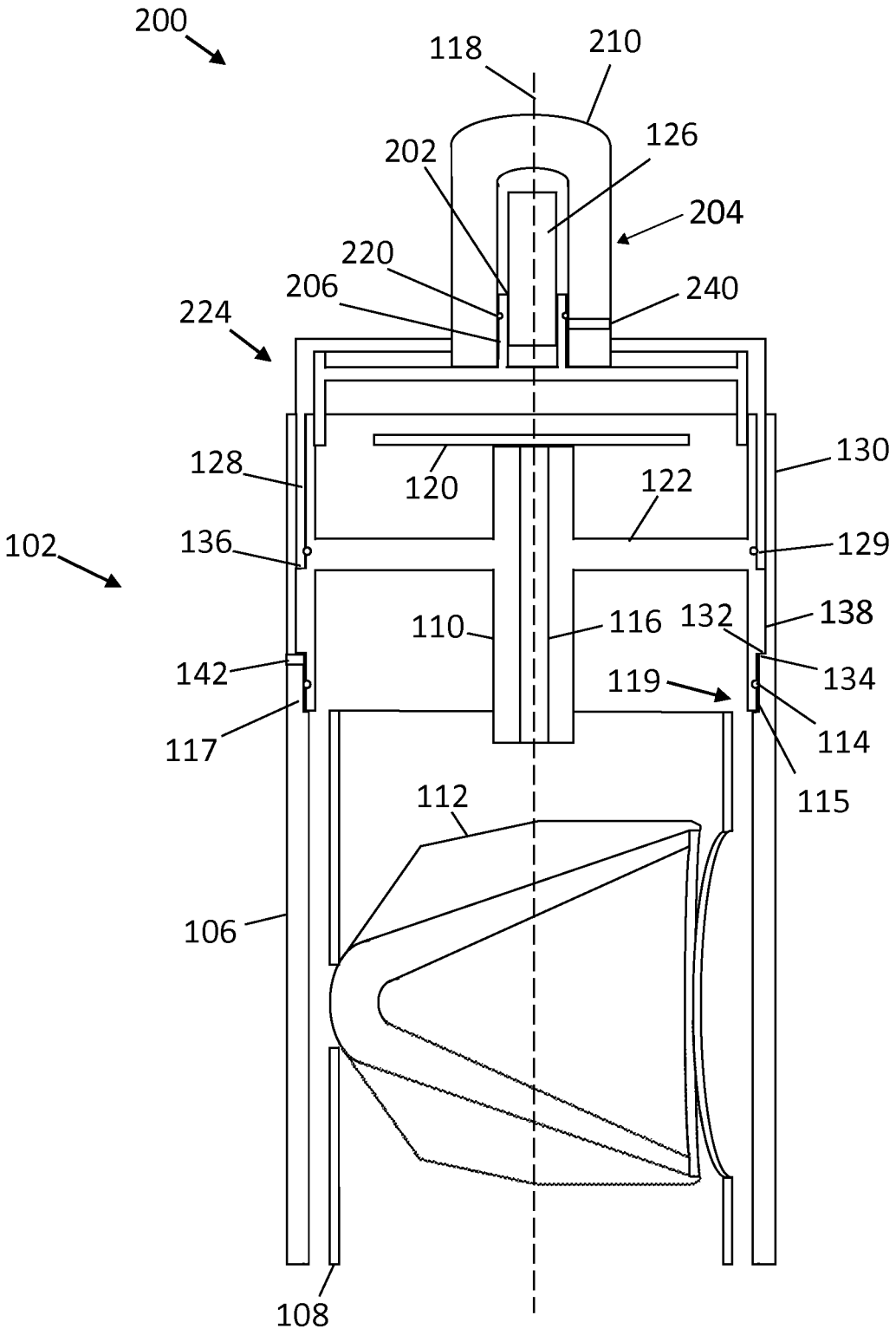
FIG. 2 is a schematic cross-sectional view of a well completion tool, in accordance with embodiments of the present disclosure.

FIG. 2 is a schematic cross-sectional view of a well completion tool 200, according to another embodiment. The tool 200 has the perforation tool 102 with a containment cover 204 that helps make the tool 102 transportable. Whereas the containment cover 104 covers the entire initiation module 124 in the tool 100, in this case the containment cover 204 just covers the detonator 126. The tool 200 has an initiation module 224 that is slightly different from the initiation module 124 of the tool 100. The initiation module 224 is engaged with a receptacle 202 of the initiation module 224 that is located along the central axis 118 of the tool 200 to position the detonator 126 at the central axis 118. The receptacle 202 has an outer wall 206 with external threading that engages with threading on the inner surface of the containment cover 204 to secure the containment cover 204 to the initiation module 224. The threading, in this case, is configured based on the discharge capacity of the detonator 126. For example, a number of threads (or thread flights) is selected based on the discharge capacity of the detonator 126.

In this case, the containment cover 204 has a curved end 210. A curved end 210 can be used to increase the strength of the containment cover 204, potentially allowing the thickness and weight of the containment cover 204 to be reduced. Here, the curved end 210 has an elliptical shape, but the curved end 210 could have any suitable curved shape consistent with providing strength to contain discharge of the detonator 126. For example, the curved end 210 could have a generally elliptical shape with a flat central portion, which could be flat only on the outer surface of the containment cover 204, or on both the outer and inner surfaces thereof. The curved end 210 could amount to rounded corners of a generally rectangular shape, the rounding selected to provide the needed strength. The rounded corners could be provided only on the outer surface of the containment cover 204, or on the inner and outer surfaces.

Clearance of the containment cover 204 is selected to provide an expansion volume for combustion products of the detonator 126. The expansion volume can be selected by adjusting the inner length and diameter of the containment cover 204. A lower expansion volume will generally result in higher pressure within the containment cover 204, so more strength (i.e. thickness) may be required, with a given detonator 126, for a smaller expansion volume than for a larger expansion volume.

A seal member 220 is provided in an unthreaded part of the outer surface of the receptacle 202 to seal between the receptacle 202 and the containment cover 204. The seal member 220 helps to contain pressure from unwanted discharge of the detonator 126 when the containment cover 204 is in place. In the tool 200, the port 140 is omitted and a port 240 is provided in the containment cover 204 itself to allow safe venting of pressure from discharge of the detonator 126. Here, the port 240 is a port through the containment cover 204, from the inner surface to the outer surface thereof, and located in the sidewall of the containment cover 204 such that installation of the containment cover 204 to its fullest extent locates the port 240 beyond the sealed volume of the containment cover 204. In this case, pressure from unwanted discharge of the detonator 126 can be safely relieved by partially removing the containment cover 204 to bring the port 240 into fluid engagement with the contained volume of the interior of the containment cover 204 to evacuate the captured gas.

Figure 3:
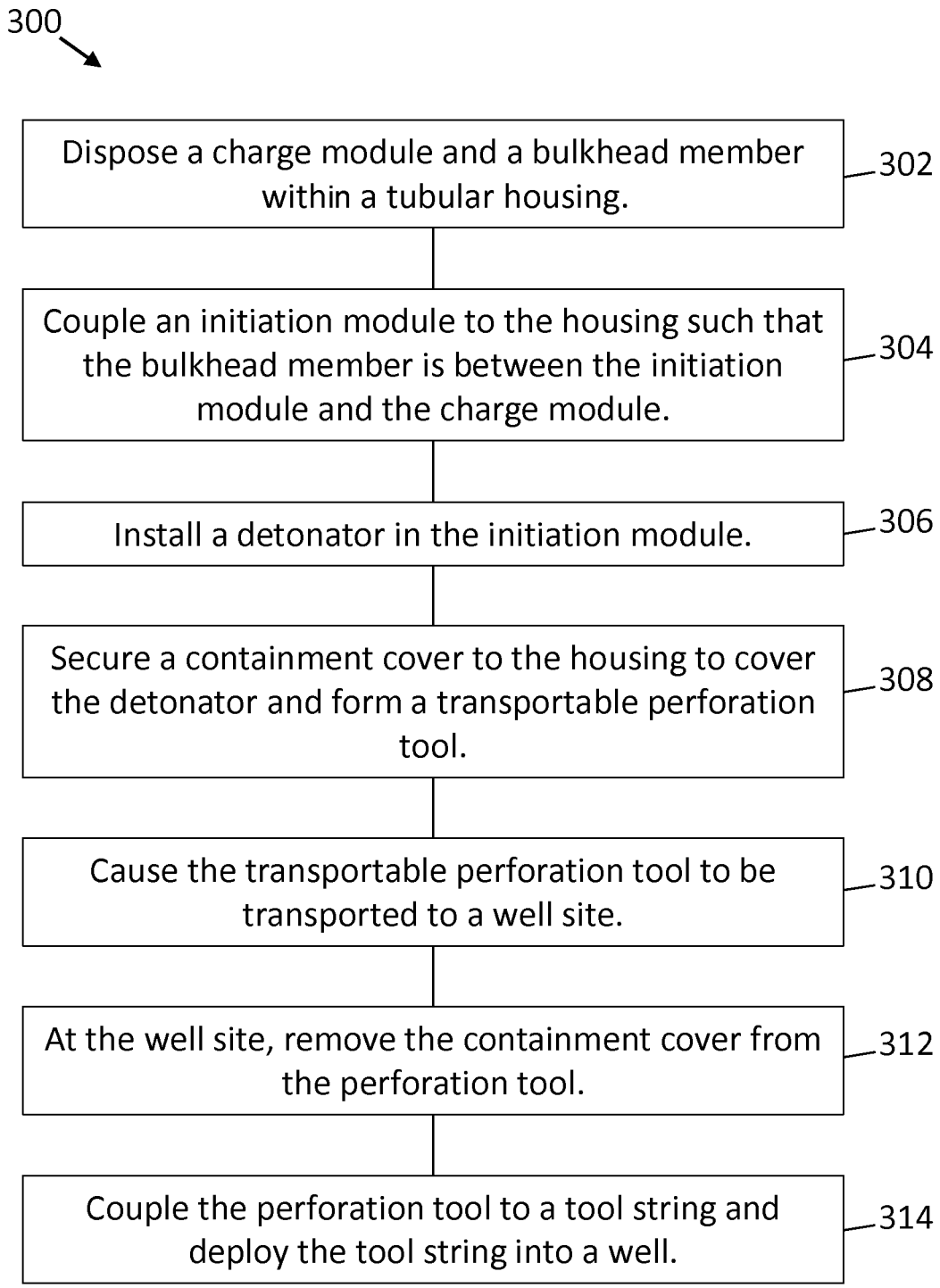
FIG. 3 is a flow diagram summarizing a method, in accordance with embodiments of the present disclosure.

FIG. 3 is a flow diagram summarizing a method 300 according to one embodiment. The method 300 can be practiced with the tool embodiments described herein. The method 300 is a method of using a perforation tool like the perforation tool 102 described above. At 302, a charge module and a bulkhead member are disposed within a tubular housing. This can be done using the charge module 108, the bulkhead member 110, and the housing 106 described above. At 304, an initiation module is coupled to the housing such that the bulkhead member is between the initiation module and the charge module, and at 306 a detonator is installed in the initiation module.

At 308, a containment cover is secured to the perforation tool to cover the detonator and to make the perforation tool transportable. The containment cover generally must have enough structural strength to contain any unwanted discharge of the detonator, and must be attached in a manner that will provide containment in the event of such unwanted discharge. In one case, a threaded connection can be used to attach the containment cover to the perforation tool. The threaded connection can be configured to contain a discharge of the detonator by providing a number of threads (or thread flights) based on the discharge capacity of the detonator. More threads (or thread flights) provides a more secure connection capable of containing a more energetic ballistic discharge.

It should be noted that other means can be used, in all the embodiments described herein, to secure a containment cover to a perforation tool to contain the ballistic discharge of a detonator within the containment cover. For example, a clamp can be tightly secured to the containment cover to securely hold the containment cover in place. The clamp can be a simple metal band clamp, or the clamp may have physical engagement features, such as prongs, to engage with features of the containment cover and/or the housing, such as grooves, to increase clamping strength. Clamps can be advantageous because they can be quickly released and removed, whereas a threaded connection must be unscrewed to remove the containment cover. Clamps can also provide an advantage in promoting sealing between the containment cover and the housing or the initiation module by applying compressive force to the containment cover. Adhesive materials can also be used to enhance security of attachment between the containment cover and the housing or initiation module. Such attachment means can also be used in combination. For example, an adhesive material can be applied to a threaded connection prior to engaging the threaded connection to enhance sealing and to enhance the security of the connection.

The containment covers described herein can be used to make a perforation tool transportable, provided the containment cover, and attachment to the perforation tool, is configured to contain unwanted detonation of the detonator. Upon installation of the containment cover, the tool can be transported to a well site at 310, the containment cover can be removed at 312, and the perforation tool can be coupled to a tool string at 314 for deployment downhole.

In certain embodiments of the present disclosure, a well completion tool includes a tubular housing, a charge module that includes at least one explosive charge within the housing, an initiation module coupled to the housing that includes a detonator, a bulkhead module within the housing between the charge module and the initiation module, and a containment cover secured to the housing and covering the detonator.

In some embodiments, the containment cover is secured to the housing by a threaded connection having a number of threads selected based on a discharge capacity of the initiation module. In some embodiments, the containment cover covers the initiation module. In some embodiments, the containment cover has a curved end. In some embodiments, the detonator is disposed along a central axis of the well completion tool. In some embodiments, the containment cover has detection means for detecting discharge of the initiation module before removing the containment cover.

In certain embodiments of the present disclosure, a well completion tool includes a tubular housing, a charge module that includes at least one explosive charge within the housing, an initiation module coupled to the housing that includes a detonator, a bulkhead module within the housing between the charge module and the initiation module, and a containment cover secured to an end of the housing and covering the initiator.

In some embodiments, the containment cover is secured to the housing by a threaded connection having a number of threads selected based on a discharge capacity of the initiation module. In some embodiments, the containment cover covers the initiation module. In some embodiments, the detonator is disposed along a central axis of the well completion tool. In some embodiments, the containment cover has detection means for detecting discharge of the detonator before removing the containment cover.

In certain embodiments of the present disclosure, a method of using a perforation tool includes disposing a charge module and a bulkhead member within a housing of the perforation tool, attaching an initiation module to the housing such that the bulkhead member is between the initiation module and the charge module, installing at least one explosive charge in the charge module, installing a detonator in the initiation module, securing a containment cover to the housing to cover the detonator and form a transportable perforation tool, causing the transportable perforation tool to be transported to a well site, at the well site, removing the containment cover from the perforation tool, attaching the perforation tool to a tool string, and deploying the tool string into a well.

In some embodiments, the containment cover is secured and removed by operating a threaded connection having a number of threads selected based on a discharge capacity of the initiation module. In some embodiments, the containment cover covers the initiation module. In some embodiments, the containment cover has a curved end. In some embodiments, the detonator is disposed along a central axis of the perforation tool.

While the foregoing is directed to embodiments of the present invention, other and further embodiments of the present disclosure may be devised without departing from the basic scope thereof, and the scope thereof is determined by the claims that follow. Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

The invention claimed is:

1. A method of using a perforation tool, comprising:

disposing a charge module and a bulkhead member within a housing of the perforation tool;

attaching an initiation module to the housing such that the bulkhead member is between the initiation module and the charge module;

installing at least one explosive charge in the charge module;

installing a detonator in the initiation module;

securing a containment cover to the housing to cover the detonator and form a transportable perforation tool, the containment cover comprising a window for detecting discharge of the initiation module before removing the containment cover, the window comprising a light-transmissive material;

causing the transportable perforation tool to be transported to a well site;

at the well site, removing the containment cover from the perforation tool;

attaching the perforation tool to a tool string; and deploying the tool string into a well.

2. The method of claim 1, wherein securing the containment cover comprises operating a threaded connection having a number of threads selected based on a discharge capacity of the initiation module.

3. The method of claim 1, wherein securing the containment cover comprises covering the initiation module.

4. The method of claim 1, wherein the containment cover has a curved end.

5. The method of claim 1, wherein installing the detonator comprises positioning the detonator along a central axis of the perforation tool.

6. A method comprising, removing a containment cover from a perforation tool comprising a housing, a charge module within the housing, an initiation module coupled to the housing, and a bulkhead module within the housing between the charge module and the initiation module, the containment cover comprising a window for detecting discharge of the initiation module before removing the containment cover, the window comprising a light-transmissive material;

attaching the perforation tool to a tool string; and deploying the tool string into a well.

7. The method of claim 6, wherein removing the containment cover comprises operating a threaded connection having a number of threads selected based on a discharge capacity of the initiation module.

8. The method of claim 6, wherein, prior to removing the containment cover, the containment cover covers the initiation module.

9. The method of claim 6, wherein the containment cover has a curved end.

10. The method of claim 6, wherein the initiation module comprises a detonator, and wherein the detonator is disposed along a central axis of the perforation tool.

11. The method of claim 6, further comprising causing the perforation tool secured with the containment cover to be transported to a well site, including the well, before removing the containment cover from the perforation tool.

12. The method of claim 6, further comprising securing the containment cover to the housing to cover the initiation module before removing the containment cover from the perforation tool.

13. The method of claim 12, further comprising:

disposing the charge module and a bulkhead member within the housing of the perforation tool; and attaching the initiation module to the housing such that the bulkhead member is between the initiation module and the charge module.

14. The method of claim 13, further comprising installing at least one explosive charge in the charge module.

15. The method of claim 13, further comprising installing at least a detonator in the initiation module.

* * * * *